US005258820A

United States Patent [19]

Tabb

[11] Patent Number: 5,258,820

[45] Date of Patent: Nov. 2, 1993

[54] PRE-RECHARGE DEVICE FOR VOLTAGE UNIFORMITY IN READ COLOR SYSTEMS

[75] Inventor: Charles H. Tabb, Penfield, N.Y.

[73] Assignee: Xerox Corporation, Stamford, Conn.

[21] Appl. No.: 921,176

[22] Filed: Jul. 29, 1992

[51] Int. Cl.[5] ..... G03G 15/01

[52] U.S. Cl. ..... 355/328; 355/208; 355/246

[58] Field of Search ..... 355/328, 327, 326, 208, 355/246, 219, 228, 229; 430/42, 45

[56] References Cited

U.S. PATENT DOCUMENTS

| | | | |
|---|---|---|---|
| 4,033,668 | 7/1977 | Prisby | 350/96 C |
| 4,660,059 | 4/1987 | O'Brien | 346/157 |
| 4,660,961 | 4/1987 | Kuramoto et al. . | |
| 4,761,669 | 8/1988 | Langdon . | |
| 4,791,452 | 12/1988 | Kasai et al. . | |
| 4,819,028 | 4/1989 | Abe . | |
| 4,833,503 | 5/1989 | Snelling | 355/259 |
| 4,868,611 | 9/1989 | Germain | 355/328 |
| 4,959,286 | 9/1990 | Tabb | 430/45 |
| 4,984,021 | 1/1991 | Williams | 355/245 |
| 4,998,139 | 3/1991 | May et al. | 355/208 |
| 5,049,949 | 9/1991 | Parker et al. | 355/328 |
| 5,080,988 | 1/1992 | Germain et al. | 430/54 |

*Primary Examiner*—A. T. Grimley
*Assistant Examiner*—T. A. Dang

[57] ABSTRACT

In a multi-color imaging apparatus utilizing a recharge step between two image creation steps for conditioning a charge retentive surface pursuant to forming the second of the two images, the voltage differential between developed and undeveloped areas of a charge retentive surface is reduced for precluding edge effect development. An erase device is used prior to the recharge step when the first image is a charged area image. A pre-charging device is utilized prior to the recharge step when the first of the two images is a discharged area image.

16 Claims, 5 Drawing Sheets

PRE-RECHARGE DEVICE FOR VOLTAGE UNIFORMITY IN READ COLOR SYSTEMS

BACKGROUND OF THE INVENTION

This invention relates generally to color imaging and more particularly to the use of plural exposure and development steps for such purposes.

One method of printing in different colors is to uniformly charge a charge retentive surface and then optically expose the surface to information to be reproduced in one color. This information is rendered visible using marking particles followed by the recharging of the charge retentive prior to a second exposure and development.

U.S. Pat. No. 4,791,452 relates to two-color imaging apparatus wherein a first latent image is formed on a uniformly charged imaging surface and developed with toner particles. The charge retentive surface containing a first developed or toned image and undeveloped or untoned background areas is then recharged prior to optically exposing the surface to form a second latent electrostatic image thereon. The recharging step is intended to provide a uniformly charged imaging surface prior to effecting a second exposure.

U.S. Pat. No. 4,819,028 discloses an electrophotographic recording apparatus capable of forming a clear multicolor image including a first visible image of a first color and a second visible image of a second color on a photoconductive drum. The electrophotographic recording apparatus is provided with a conventional charger unit and a second charger unit for charging the surface of the photoconductive drum after the first visible image is formed thereon so as to increase the surface potential of the photoconductive drum to prevent the first visible image from being mixed with a second color and scratched off from the surface of the photoconductive drum by a second developing unit.

U.S. Pat. No. 4,660,961 discloses a copying apparatus of the electrostatic type which enables two images to be synthesized on one surface of a copying paper using original positive image sources without preparing negative images sources prior to the copying process. The copying apparatus can also synthesize a plurality of images in different colors on a single sheet of paper.

U.S. Pat. No. 4,761,669 relates to creating two-color images. A first image is formed using the conventional xerographic process. Thus, a charge retentive surface is uniformly charged followed by light exposure to form a latent electrostatic image on the surface. The latent image is then developed. A corona generator device is utilized to erase the latent electrostatic image and increase the net charge of the first developed image to tack it to the surface electrostatically. This patent proposes the use of an erase lamp, if necessary, to help neutralize the first electrostatic image. A second electrostatic image is created using an ion projection device. The ion image is developed using a second developer of a different color.

U.S. Pat. No. 4,033,688 discloses a color copying apparatus which utilizes a light-lens scanning device for creating plural color images. This patent discloses multiple charge/expose/develop steps.

U.S. Pat. No. 4,833,503 discloses a multi-color printer wherein a a recharging step is employed following the development of a first image. This recharging step, according to the patent is used to enhance uniformity of the photoreceptor potential, i.e. neutralize the potential of the previous image.

U.S. Pat. No. 4,660,059 discloses an ionographic printer. A first ion imaging device forms a first image on the charge retentive surface which is developed using toner particles. The charge pattern forming the developed image is neutralized prior to the formation of a second ion image.

U.S. patent application Ser. No. 856,311 Filed on Mar. 23, 1992 and assigned to the same assignee as the instant application discloses a printing system wherein charged area images and discharged area images are created, the former being formed first and the latter being proceeded by a recharging of the imaging surface.

A number of commercial printers employ the charge/expose/develop/recharge imaging process. For example, the Konica 9028, a multi-pass color printer forms a single color image for each pass. Each such pass utilizes a recharge step following development of each color image. The Panasonic FPC1 machine, like the Konica machine is a multi-pass color device. In addition to a recharge step the FPC1 machine employs an AC corona discharge device prior to recharge.

In the method of creating multi-color images using a conventional charge/expose/develop process as illustrated in the patents discussed above, voltage non-uniformity between developed (toned) and non-developed (untoned) areas on the charge retentive occurs. This non-uniformity in potential causes undesirable edge effect development. The edge effect phenomena results in development of the edges of an image of one color with the marking particles of a second color.

Also with image on image, the change in voltage due to the toned image can be responsible for color shifts and loss in latitude.

BRIEF SUMMARY OF THE INVENTION

Briefly, in accordance with the present invention, voltage non-uniformity between toned and untoned images on a charge retentive surface is reduced by subjecting the charge retentive surface containing toned and untoned areas to an erase step using a source of illumination prior to recharging. The toned area corresponds to a charged area which is developed using charged area development (CAD). Images developed using charged area development are commonly referred to as CAD images. Through use of the erase step following the development of the CAD image and prior to the recharge step, the voltage difference between toned (developed) and untoned (Background) areas of the charge retentive surface is reduced after recharging from 60 volts to 20 volts thereby solving the problem of undesirable edge development.

Creation of the CAD image which may, for example, comprise a black image is followed by the formation of one or more color images. The color images are formed by selectively discharging the charge retentive surface in image areas. The discharged areas are developed using discharge area development (DAD). Such images are commonly referred to as DAD images. It has been found that the erase step noted above adversely affects transfer latitude when employed following DAD image creation. Accordingly, a pre-charging step is employed following DAD image development and prior to recharge. Thus, voltage non-uniformity between toned and untoned images on a charge retentive following development of a DAD image is satisfactorily reduced through the use of a pre-charge step following a DAD image development in combination with an [d] erase step following development of a CAD image.

DETAILED DESCRIPTION OF THE PREFERRED EMBODIMENT OF THE INVENTION

This invention relates to an imaging system which is used to produce a color output in a single pass. It will be understood that it is not intended to limit the invention to the embodiment disclosed. On the contrary, it is intended to cover all alternatives, modifications and equivalents as may be included within the spirit and scope of the invention as defined by the appended claims.

Figure 1:
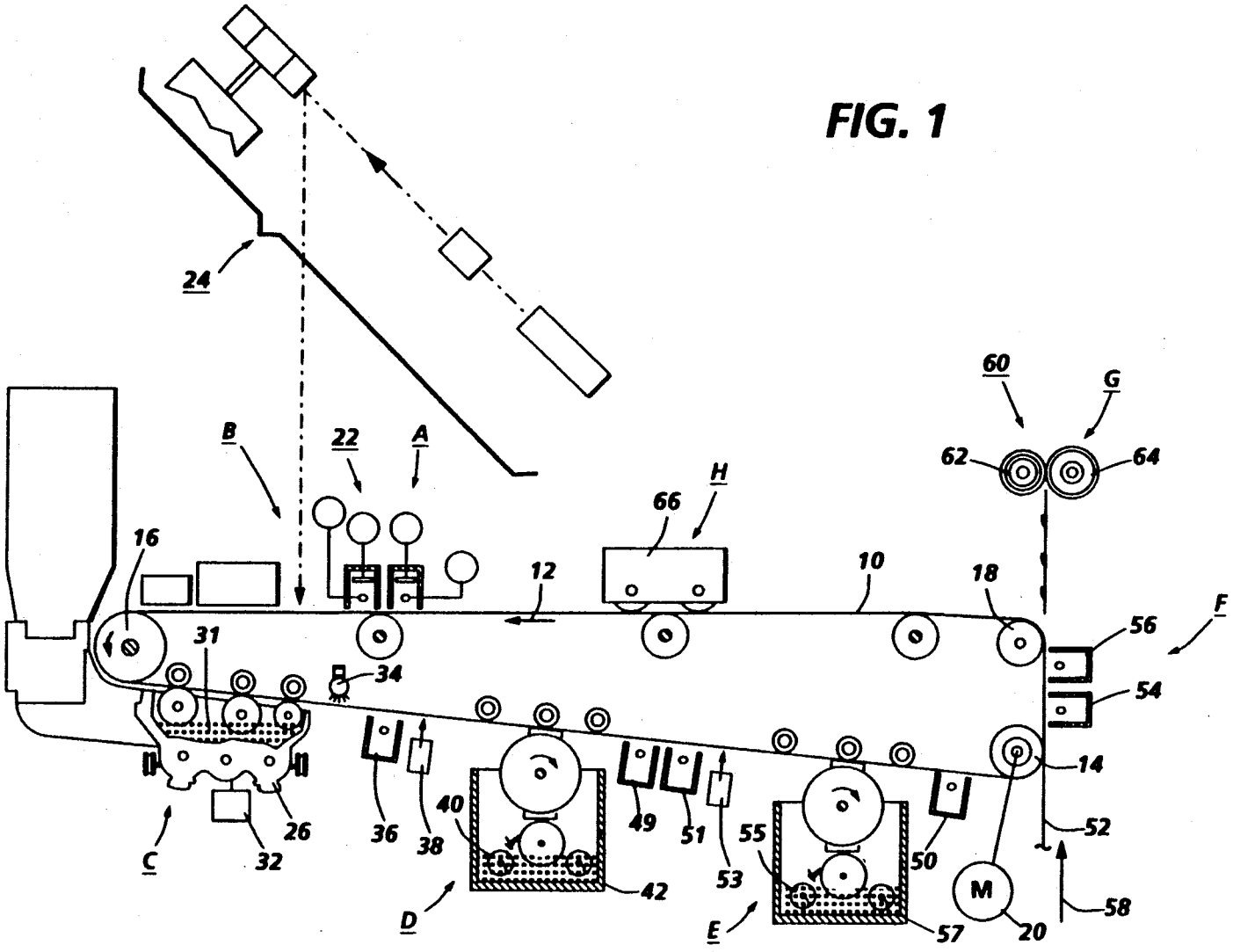
FIG. 1 is schematic illustration of an imaging apparatus incorporating the development system features of the invention.

Turning now to FIG. 1, the electrophotographic printing machine of the present invention uses a charge retentive surface in the form an Active Matrix (AMAT) photoreceptor belt 10 supported for movement in the direction indicated by arrow 12, for advancing sequentially through the various xerographic process stations. The belt is entrained about a drive roller 14 and two tension rollers 16 and 18 and the roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based input and/or output scanning device 24 which causes the charge retentive surface to be discharged in accordance with the output from the scanning device. Preferably the scanning device is a two level laser Raster Output Scanner (ROS). Alternatively, the ROS could be replaced by other xerographic exposure devices.

The photoreceptor, which is initially charged to a voltage $V_0$, undergoes dark decay to a level $V_{ddp}$ equal to about −700 volts. When exposed at the exposure station B it is discharged to $V_{background}$ equal to about −100 volts. Thus after exposure, the photoreceptor contains a monopolar voltage profile of high and low voltages, the former corresponding to charged areas and the latter corresponding to discharged or background areas.

At a first development station C, a magnetic brush developer structure, indicated generally by the reference numeral 26 advances insulative magnetic brush (IMB) material 31 into contact with the electrostatic latent image, $V_{CAD}$. The development structure 26 comprises a plurality of magnetic brush roller members. These magnetic brush rollers present, for example, positively charged black toner material to the charged image areas for development thereof. Appropriate developer biasing is accomplished via power supply 32. Electrical biasing is such as to effect charged area development (CAD) of the higher of the two voltage levels on the photoreceptor with the material 31.

A post CAD erase lamp 34 disposed adjacent the backside of the belt 10 serves to reduce the charge level of the photoreceptor in the toned or developed areas. Such reduction decreases the voltage difference between the toned and untoned photoreceptor areas.

A negative recharging corona device 36 is employed for raising the voltage level of both the toned and untoned areas on the photoreceptor pursuant to a subsequent imaging or exposure step. The aftermentioned voltage difference is further reduced to within acceptable limits.

A second exposure or imaging device 38 which may comprise a laser based input and/or output structure is utilized for selectively discharging the photoreceptor subsequent to the recharging step effected by the corona discharge device 36. At this point, the photoreceptor contains toned areas at relatively high voltage levels and untoned areas at relatively low voltage, $V_{DAD}$ levels. These low voltage, untoned areas represent highlight color image areas which are developed using discharged area development (DAD). To this end, a negatively charged, developer material 40 comprising color toner is employed. The toner, which by way of example may be red, is contained in a developer housing structure 42 disposed at a second developer station D and is presented to the latent images on the photoreceptor by a plurality of magnetic brush developer rollers. A power supply (not shown) serves to electrically bias the developer structure to a level effective to develop the DAD image areas with negatively charged red toner particles.

A pre-charge corona device 49 serves to condition the voltages representative of both CAD and DAD developed images and background areas of the photoreceptor such as to reduce the voltage differential between toned and untoned areas.

A recharge corona device 51 serves to reduce the the foregoing voltage differential as well as condition the photoreceptor for the creation of third image.

A third latent images is created using an imaging or exposure member 53. In this instance, a second DAD image is formed. This image is developed using a third color toner 55 contained in a developer housing 57. Suitable electrical biasing of the housing 57 is provided by a power supply, not shown. The developer housing structures 42 and 57 are preferably of the type which do not interact with previously developed images.

Because the composite image developed on the photoreceptor consists of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station F. The sheet of support material is advanced to transfer station E by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station F.

Transfer station F includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station G. Fusing station F includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown for subsequent removal from the printing machine by the operator.

After the sheet of support material is separated from photoconductive surface of belt 10, the residual toner particles carried by the non-image areas on the photoconductive surface are removed therefrom. These particles are removed at cleaning station H using a cleaning brush structure contained in a housing 66.

Figure 2A:
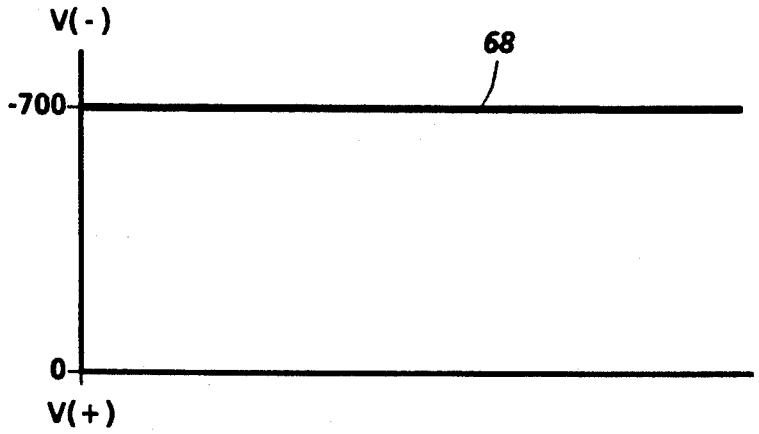
FIG. 2*a* shows the photoreceptor voltage profile after uniform charging.
Figure 2B:
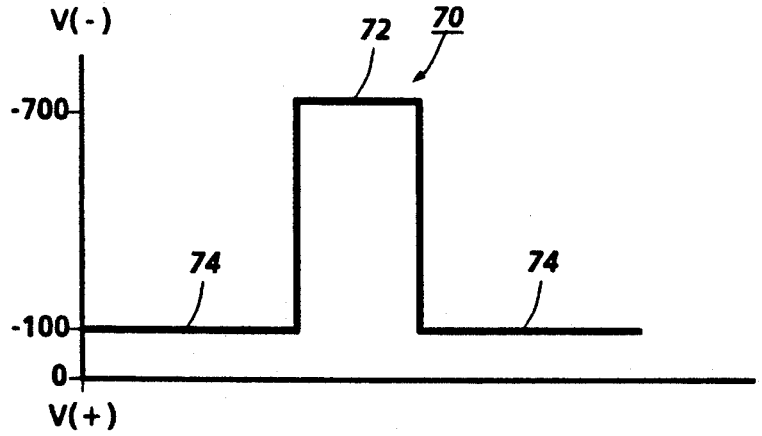
FIG. 2*b* shows the photoreceptor voltage profile after a first exposure step.

The voltage profiles on the photoreceptor 10 depicting the image forming process steps are illustrated FIG. 2*a* through 2*j*. FIG. 2*a* illustrates the voltage profile 68 on photoreceptor belt after the belt has been uniformly charged. The photoreceptor is initially charged to a voltage slightly higher than the −700 volts indicated but after dark decay the $V_{CAD}$ voltage level is −700. After a first exposure at exposure station B, the voltage profile comprises high and low voltage levels 72 and 74, respectively. The level 72 is at the original −700 volts represents the CAD image area to be developed by the black developer housing 26 while the level 74 at −100 volts (FIG. 2*b*) represents the area discharged by the laser 24 and corresponds to the background for the first development step.

Figure 2C:
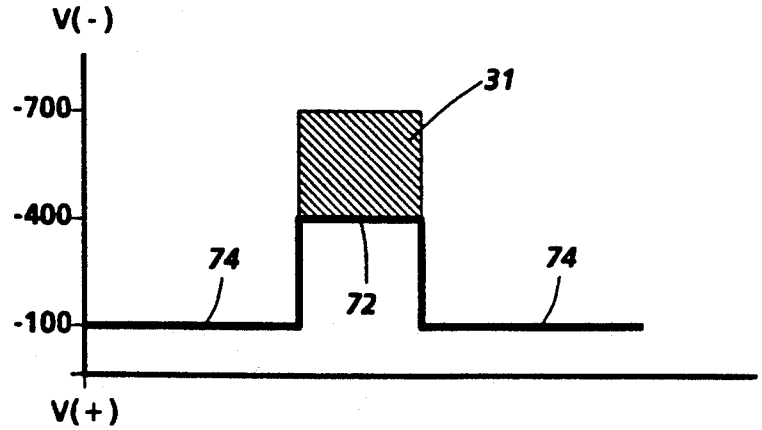
FIG. 2*c* shows the photoreceptor voltage profile after a first development step.

During the first development step, black toner adheres to the CAD image area and causes the photoreceptor in the image area to be reduced to approximately −400 volts (FIG. 2*c*). Thus, a voltage difference of −300 volts exists between the toned (−400 volts) and (−100 volts) areas of the photoreceptor.

Figure 2D:
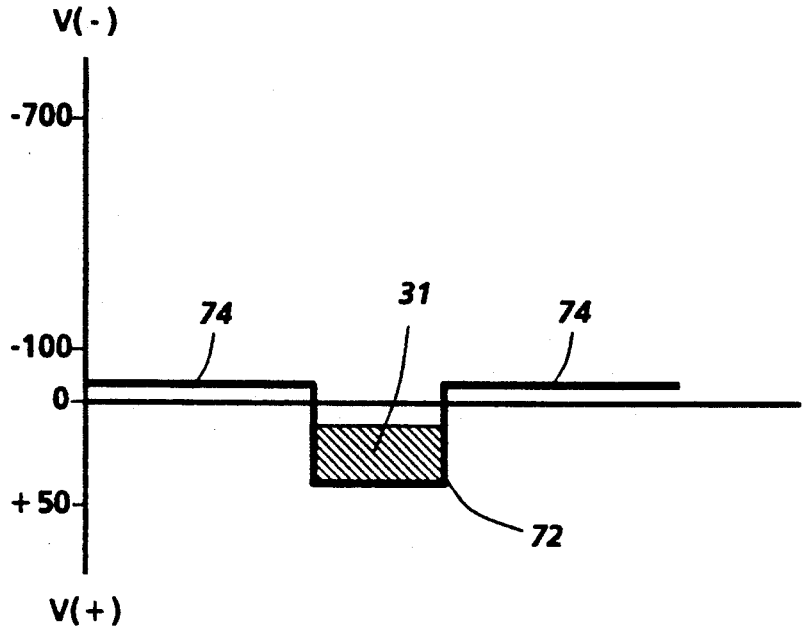
FIG. 2*d* shows the photoreceptor voltage profile after an erase step according to the present invention.
Figure 2E:
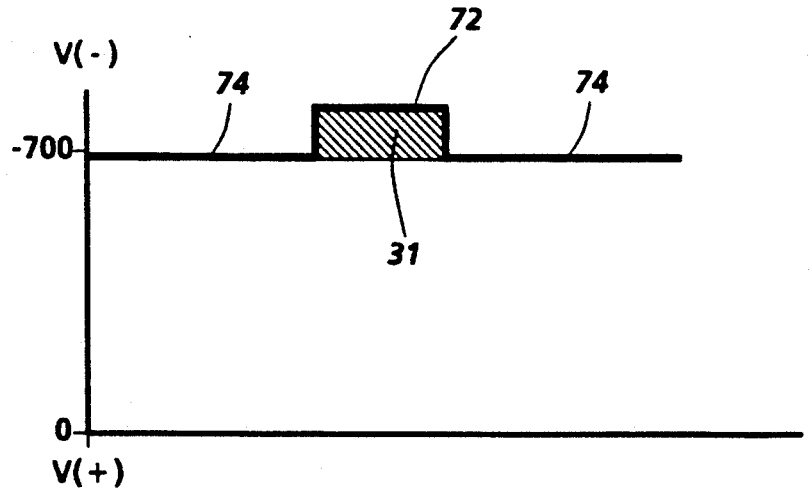
FIG. 2*e* shows the photoreceptor voltage profile after a recharging step.
Figure 2F:
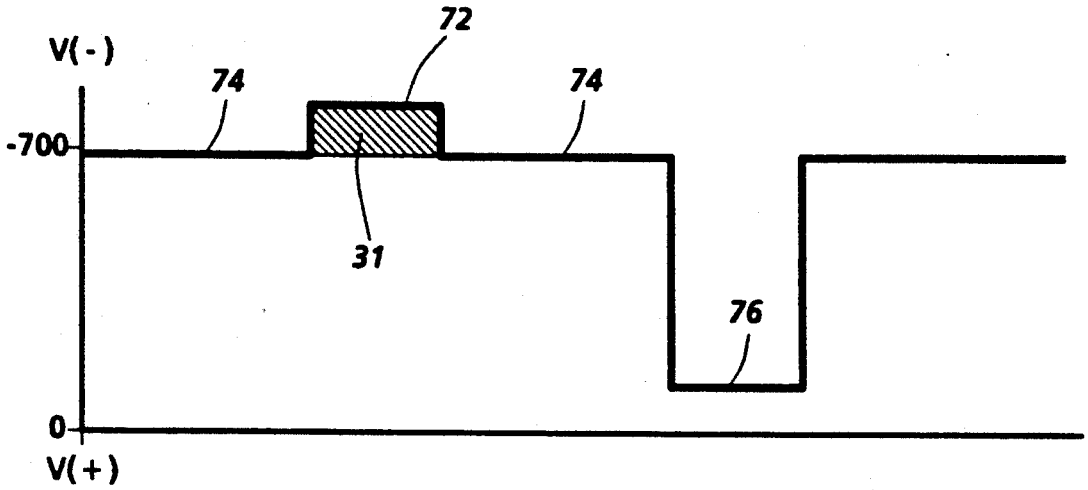
FIG. 2*f* shows the photoreceptor voltage profile after a second exposure step.

In order to minimize the adverse effects caused by such voltage differential, an erase step is performed prior to recharging of the photoreceptor pursuant to creation of a second latent electrostatic image. Thus, as shown in FIG. 2*d*, the voltage differential between the toned and untoned areas is −150 volts. When the toned and untoned areas of the photoreceptor are subjected to the recharging step using corona discharge device 36 the toned areas charge at a faster rate than the untoned areas resulting in the toned area being converted from a positive voltage to a somewhat more negative voltage than the untoned areas. Thus, the 150 volt voltage differential is reduced to about 20 volts as illustrated in FIG. 2E. Without the erase step, the voltage differential after the recharge step would be about 60 volts.

Figure 2G:
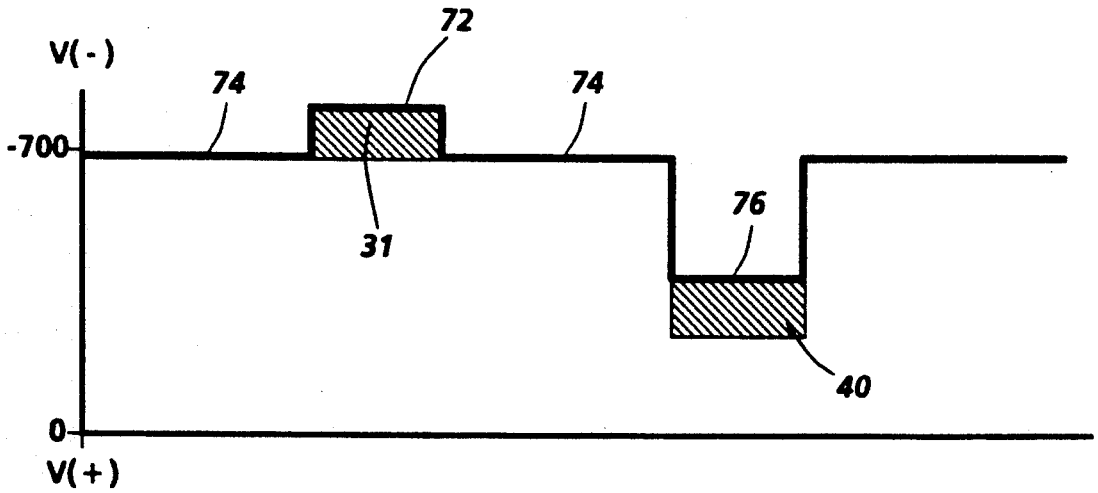
FIG. 2*g* shows the photoreceptor voltage profile after a second development step.
Figure 2H:
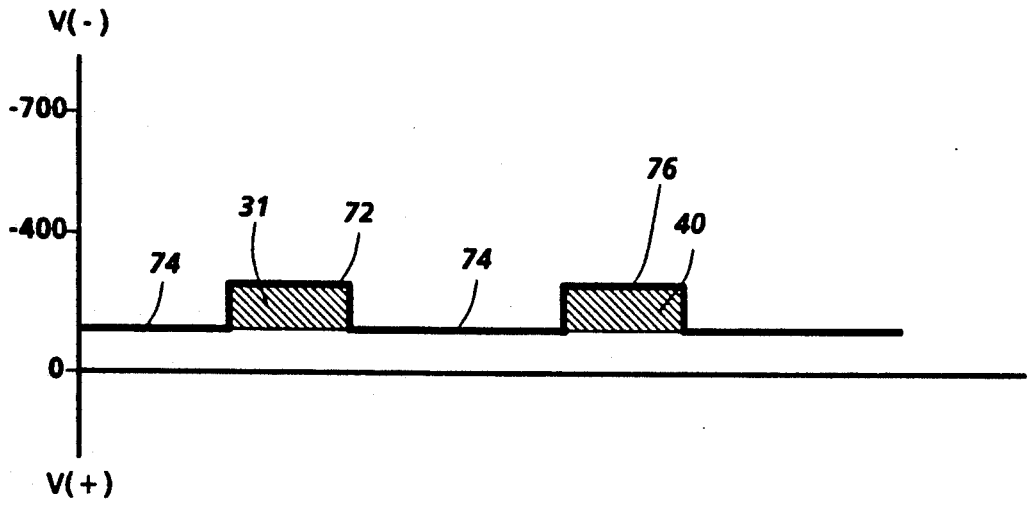
FIG. 2*h* shows the photoreceptor voltage profile following a pre-charge recharge step.
Figure 2I:
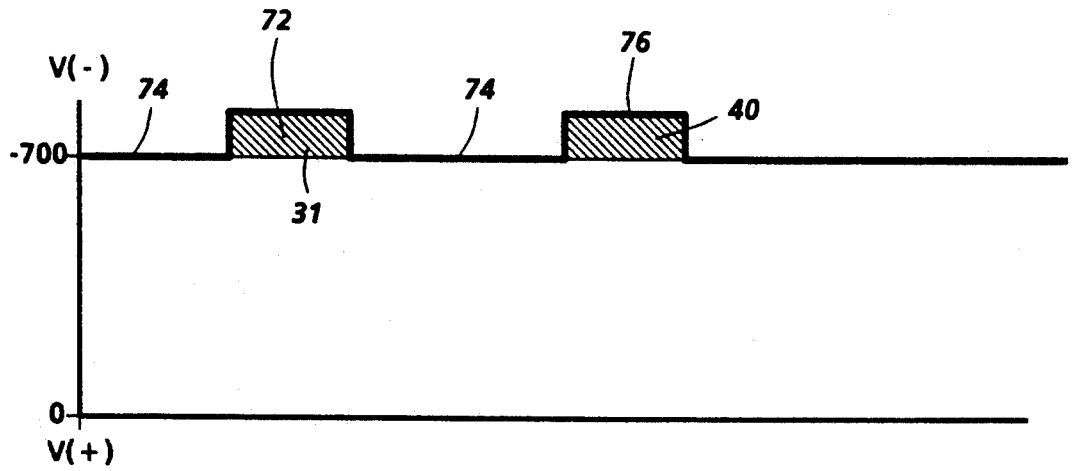
FIG. 2*i* shows the photoreceptor voltage profile after a recharge step following the pre-charge step of FIG. h.

After the recharge step, the photoreceptor is again ready for image formation thereon. To this end, the second imaging device 38 discharges the photoreceptor to form a DAD image area 76 shown in FIG. 2F. The DAD image area is developed, as depicted in FIG. 2G, with highlight color toner 40 using the developer housing 42.

Figure 2J:
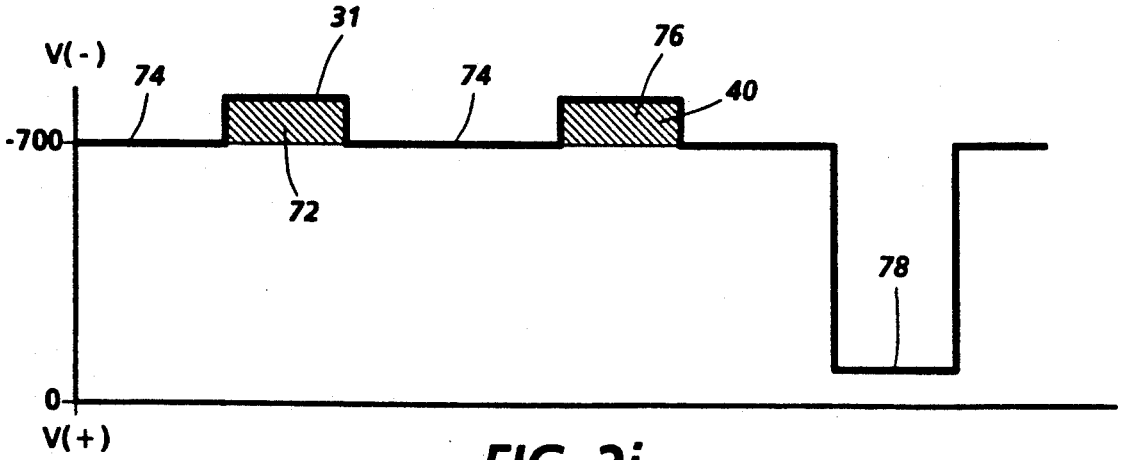
FIG. 2*j* shows the photoreceptor profile after a third exposure step.

Prior to the creation of a third (second DAD) image 78, the photoreceptor is conditioned (FIGS. 2*h* and 2*i*) using a pre-charge corona device 49 and a recharge corona device 51, which devices serve to create a more uniform voltage profile for subsequent image formation and development. The DAD image 78 is formed using the exposure or imaging member 53. This is illustrated in FIG. 2*j*.

While the foregoing description was directed to a highlight color process it will be appreciated that the invention may also be used in a process color printer as well as a multiple color highlight color machine.

What is claimed is:

1. A method for creating color images, said method comprising:

moving a charge retentive surface past a plurality of xerographic image formation members in a single pass;

uniformly charging said charge retentive surface to a predetermined voltage level;

selectively discharging said charge retentive surface to delineate DAD image areas and background areas thereon, said background areas corresponding to charged areas on said charge retentive surface, said charged and background areas having a voltage differential therebetween;

developing said DAD image areas with toner particles of a first color;

subsequent to said developing step, conditioning said charge retentive surface to reduce the voltage differential between said DAD image areas and said background areas;

subjecting said charge retentive surface to corona charges to both recharge said charge retentive surface to a predetermined voltage level and for further reducing the voltage differential between said DAD image areas and said predetermined voltage level;

forming additional DAD image areas on said charge retentive surface;

developing said DAD image areas with toner particles having a color different from said first color.

2. The method according to claim 1 wherein said step of conditioning comprises using a corona discharge device.

3. A method for creating color images, said method comprising:

moving a charge retentive surface past a plurality of xerographic image formation members;

uniformly charging said charge retentive surface to a predetermined voltage level;

selectively discharging said charge retentive surface to delineate CAD image areas and background areas thereon, said background areas corresponding to discharged areas on said charge retentive surface, said charged and background areas having a voltage differential therebetween;

developing said CAD image areas with toner particles of a first color;

subsequent to said developing step, conditioning said charge retentive surface to reduce the voltage differential between said CAD image areas and said background areas;

subjecting said charge retentive surface to corona charges to both recharge said charge retentive surface to a predetermined voltage level and for further reducing the voltage differential between said CAD image areas and said predetermined voltage level;

selectively discharging said photoreceptor to delineate DAD image areas and background areas thereon, said background areas corresponding to charged areas on said charge retentive surface;

developing said DAD image areas with toner particles of a second color;

conditioning said charge retentive surface to reduce a voltage differential between said DAD image areas and said background areas;

subjecting said charge retentive surface to corona charges to both recharge said charge retentive surface to a predetermined voltage level and for further reducing the voltage differential between said DAD image areas and said predetermined voltage level;

forming additional DAD image areas on said charge retentive surface; and developing said additional DAD image areas with toner particles having a color different from said first and second colors.

4. The method according to claim 3 wherein said step of conditioning said charge retentive surface to reduce the voltage differential between said CAD image areas and said background areas comprises using an erase device.

5. The method according to claim 3 wherein said step of conditioning said charge retentive surface to reduce the voltage differential between said DAD image areas and said background areas comprises using a corona discharge device.

6. The method according to claim 4 wherein said step of conditioning said charge retentive surface to reduce the voltage differential between said DAD image areas and said background areas comprises using a corona discharge device.

7. The method according to claim 5 wherein said step of moving a charge retentive surface past a plurality of xerographic image formation members is effected in a single pass of said charge retentive surface past said members.

8. The method according to claim 6 wherein said step of moving a charge retentive surface past a plurality of xerographic image formation members is effected in a single pass of said charge retentive surface past said members.

9. Apparatus for creating color images, said apparatus comprising:

means for moving a charge retentive surface past a plurality of xerographic image formation members in a single pass;

means for uniformly charging said charge retentive surface to a predetermined voltage level;

means for selectively discharging said charge retentive surface to delineate DAD image areas and background areas thereon, said background areas corresponding to charged areas on said charge retentive surface, said charged and background areas having a voltage differential therebetween;

means for developing said DAD image areas with toner particles of a first color;

means positioned after said developing means for conditioning said charge retentive to reduce the voltage differential between said DAD image areas and said background areas;

means for subjecting said charge retentive surface to corona charges to both recharge said charge retentive surface to a predetermined voltage level and for further reducing the voltage differential between said DAD image areas and said predetermined voltage level;

means for forming additional DAD image areas on said charge retentive surface;

means for developing said DAD image areas with toner particles having a color different from said first color.

10. Apparatus according to claim 9 wherein said means for conditioning comprises a corona discharge device.

11. Apparatus for creating color images, said apparatus comprising:

means for moving a charge retentive surface past a plurality of xerographic image formation members;

means for uniformly charging said charge retentive surface to a predetermined voltage level;

means for selectively discharging said charge retentive surface to delineate CAD image areas and background areas thereon, said background areas corresponding to discharged areas on said charge retentive surface, said charged and background areas having a voltage differential therebetween;

means for developing said CAD image areas with toner particles of a first color;

means positioned after said developing means for conditioning said charge retentive surface to reduce the voltage differential between said CAD image areas and said background areas;

means for subjecting said charge retentive surface to corona charges to both recharge said charge retentive surface to a predetermined voltage level and for further reducing the voltage differential between said CAD image areas and said predetermined voltage level;

means for selectively discharging said photoreceptor to delineate DAD image areas and background areas thereon, said background areas corresponding to charged areas on said charge retentive surface;

means for developing said DAD image areas with toner particles of a second color;

means positioned after said DAD developing means for conditioning said charge retentive surface to reduce the voltage differential between said DAD image areas and said background areas;

means for subjecting said charge retentive surface to corona charges to both recharge said charge retentive surface to a predetermined voltage level and for further reducing the voltage differential between said DAD image areas and said predetermined voltage levels;

means for forming additional DAD image areas on said charge retentive surface; and means for developing said additional DAD image areas with toner particles having a color different from said first and second colors.

12. Apparatus according to claim 11 wherein said means for conditioning said charge retentive surface to reduce the voltage differential between said CAD image areas and said background areas comprises an erase device.

13. Apparatus according to claim 11 wherein said means for conditioning said charge retentive surface to reduce the voltage differential between said DAD image areas and said background areas comprises a corona discharge device.

14. Apparatus according to claim 12 wherein said means for conditioning said charge retentive surface to reduce the voltage differential between said DAD image areas and said background areas comprises a corona discharge device.

15. Apparatus according to claim 13 wherein said means for moving a charge retentive surface past a plurality of xerographic image formation members is effected in a single pass of said charge retentive surface past said members.

16. Apparatus according to claim 14 wherein said means for moving a charge retentive surface past a plurality of xerographic image formation members is effected in a single pass of said charge retentive surface past said members.

* * * * *